US005294966A

United States Patent [19]

Shiokawa

[11] Patent Number: 5,294,966

[45] Date of Patent: Mar. 15, 1994

[54] IMAGE FORMING SYSTEM HAVING FIRST AND SECOND PRINT MODES WHICH CONTROL SHEET AT TRANSFER REGISTRATION ROLLERS

[75] Inventor: Masami Shiokawa, Saitama, Japan

[73] Assignee: Fuji Xerox Co., Ltd., Tokyo, Japan

[21] Appl. No.: 761,506

[22] Filed: Sep. 18, 1991

[30] Foreign Application Priority Data

Sep. 21, 1990 [JP] Japan ..... 2-253210

[51] Int. Cl.[5] ..... G03G 15/00

[52] U.S. Cl. ..... 355/317; 346/160; 355/313; 358/436

[58] Field of Search ..... 358/486, 300, 404, 435, 358/436, 439, 434, 443, 444; 355/204, 208, 313, 316, 317; 346/76 L, 108, 160; 395/111

[56] References Cited

U.S. PATENT DOCUMENTS 4,786,923 11/1988 Shimizu ..... 346/160
4,914,485 4/1990 Emori ..... 355/313
4,918,489 4/1990 Inage et al. ..... 355/316 X
4,956,651 9/1990 Emori ..... 346/108
4,962,404 10/1990 Wakikaido et al. ..... 355/317 X
4,992,882 2/1991 Ikenoue et al. ..... 346/160 X

*Primary Examiner*—A. T. Grimley
*Assistant Examiner*—Robert Beatty
*Attorney, Agent, or Firm*—Finnegan, Henderson, Farabow, Garrett & Dunner

[57] ABSTRACT

An image forming system for forming an image by supplying a sheet of paper from a sheet supply section to an image forming section through a transfer path. In a first print mode, the sheet of paper is placed on standby in a sync transfer section provided on the transfer path, and image data transferred thereafter is printed in the image forming section, and in a second print mode, the sheet of paper is transferred to the sync transfer section without stopping the sheet of paper at the sync transfer section, transfer of image data is requested, and the image data transferred is printed in the image forming section.

6 Claims, 8 Drawing Sheets

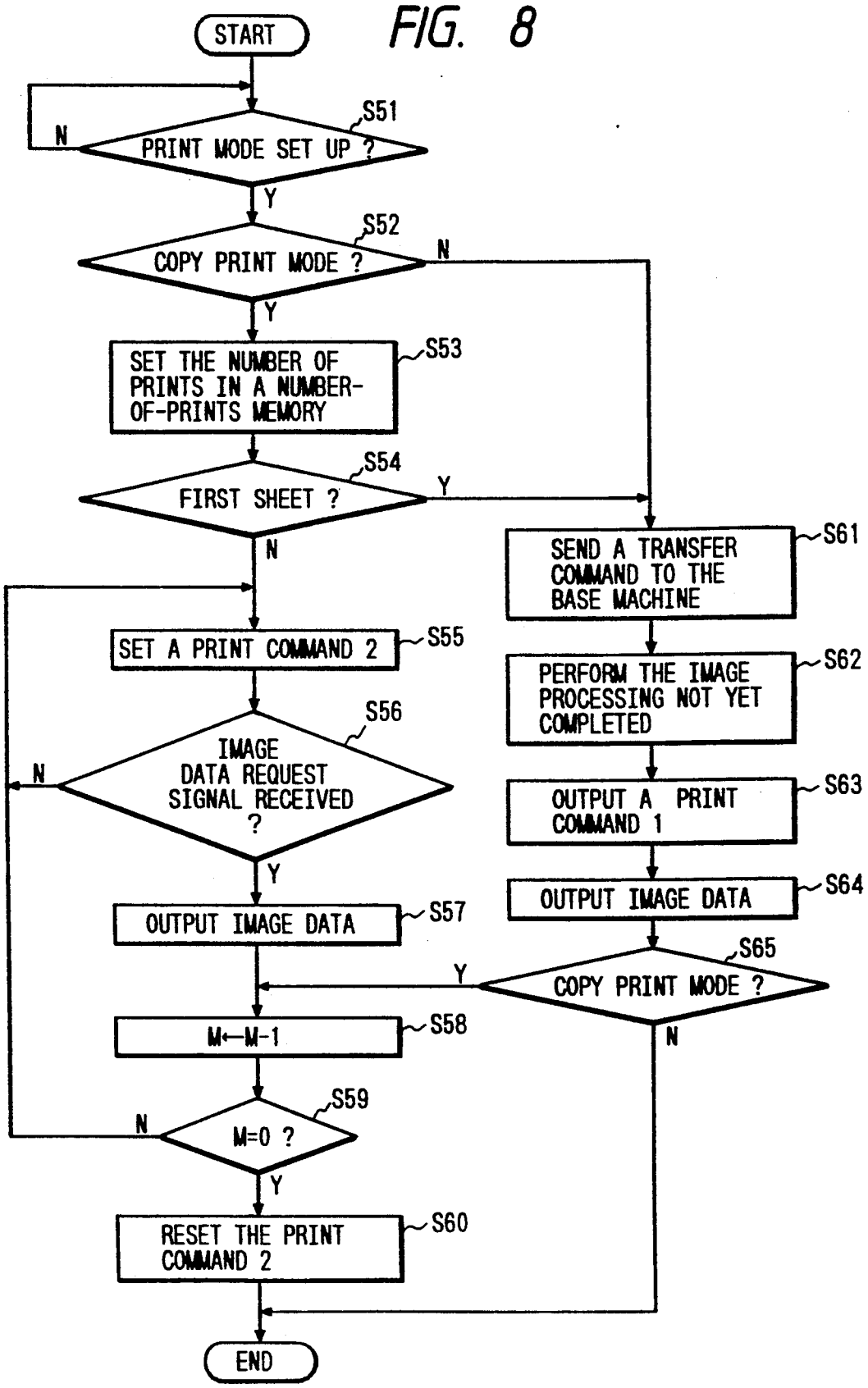
FIG. 8
START
S51
PRINT MODE SET UP ?
N
Y
S52
COPY PRINT MODE ?
N
Y
SET THE NUMBER OF PRINTS IN A NUMBER-OF-PRINTS MEMORY
S53
S54
FIRST SHEET ?
Y
N
SEND A TRANSFER COMMAND TO THE BASE MACHINE
S61
SET A PRINT COMMAND 2
S55
PERFORM THE IMAGE PROCESSING NOT YET COMPLETED
S62
S56
IMAGE DATA REQUEST SIGNAL RECEIVED ?
N
OUTPUT A PRINT COMMAND 1
S63
Y
OUTPUT IMAGE DATA
S64
OUTPUT IMAGE DATA
S57
S65
Y
COPY PRINT MODE ?
M←M-1
S58
N
S59
N
M=0 ?
Y
RESET THE PRINT COMMAND 2
S60
END

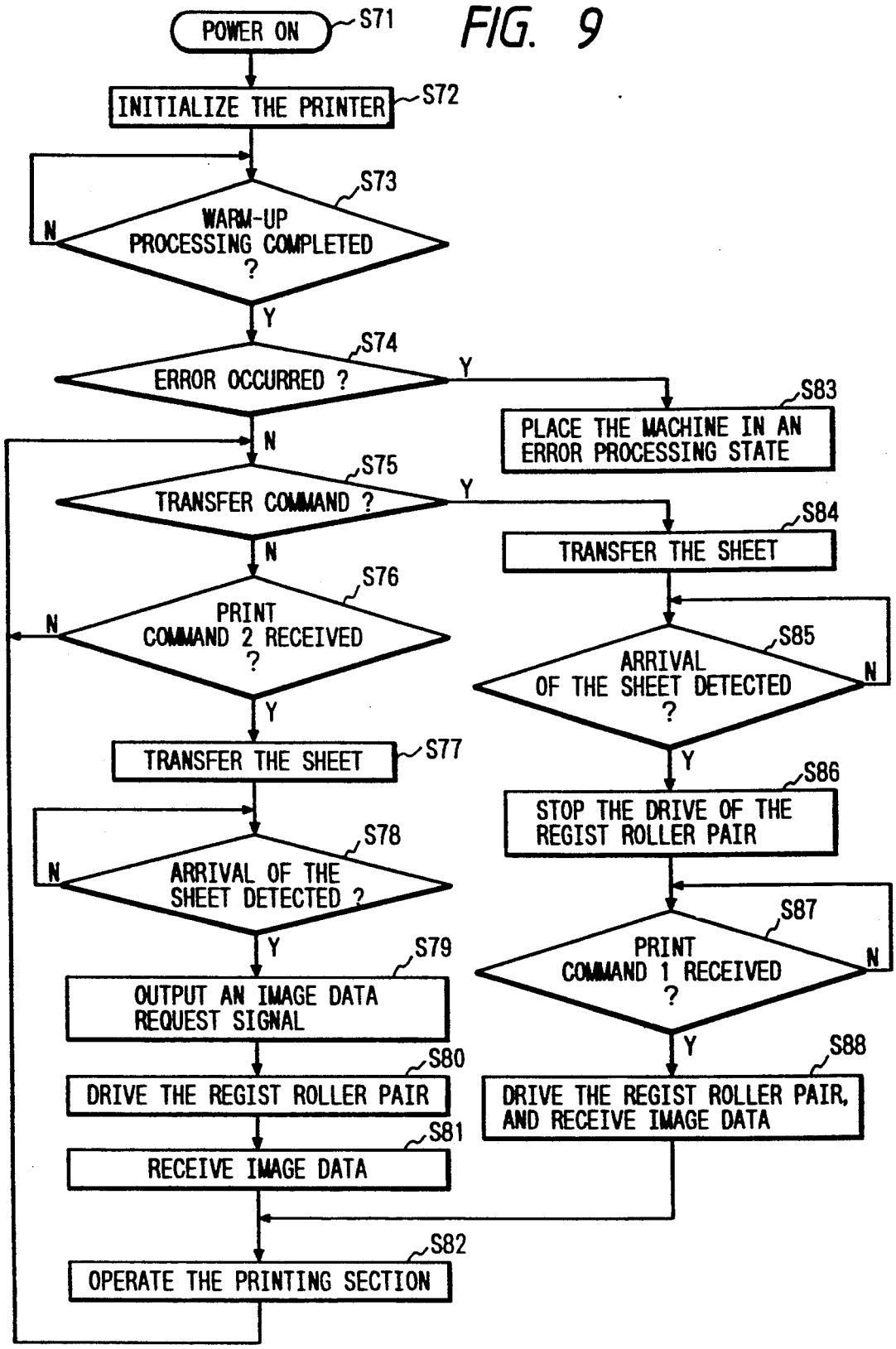
FIG. 9
POWER ON
S71
INITIALIZE THE PRINTER
S72
S73
WARM-UP PROCESSING COMPLETED ?
N
Y
S74
ERROR OCCURRED ?
Y
S83
PLACE THE MACHINE IN AN ERROR PROCESSING STATE
N
S75
TRANSFER COMMAND ?
Y
S84
TRANSFER THE SHEET
N
S76
PRINT COMMAND 2 RECEIVED ?
N
Y
S85
ARRIVAL OF THE SHEET DETECTED ?
N
Y
TRANSFER THE SHEET
S77
S86
STOP THE DRIVE OF THE REGIST ROLLER PAIR
S78
ARRIVAL OF THE SHEET DETECTED ?
N
Y
S87
PRINT COMMAND 1 RECEIVED ?
N
S79
OUTPUT AN IMAGE DATA REQUEST SIGNAL
Y
S88
S80
DRIVE THE REGIST ROLLER PAIR
DRIVE THE REGIST ROLLER PAIR, AND RECEIVE IMAGE DATA
S81
RECEIVE IMAGE DATA
S82
OPERATE THE PRINTING SECTION

IMAGE FORMING SYSTEM HAVING FIRST AND SECOND PRINT MODES WHICH CONTROL SHEET AT TRANSFER REGISTRATION ROLLERS

BACKGROUND OF THE INVENTION

1. Field of the Invention

The present invention relates to an image forming system, such as a copying machine or a laser beam printer, and more particularly to an image forming system operable in dual modes, a normal print mode and a copy print mode.

2. Discussion of the Related Art

A conventional laser beam printer includes a plurality of sheet trays, for example, three sheet trays 1 to 3, as shown in FIG. 2. A sheet of paper 4 to be recorded thereon is selectively picked up from one of those trays 1 to 3 by means of a pick-up roller 5 when the roller receives a control signal from a host computer (not shown). The sheet 4 picked up by the pick-up roller 5 is transferred to paired registration rollers 8*a* and 8*b* as a sync transfer section by pairs of transfer rollers 6*a* and 6*b* and 7*a* and 7*b*. The paired regist rollers 8*a* and 8*b* are driven at a print start timing, that is, after a predetermined time elapses from the start of exposure of a photoreceptor drum 10 to light from an image forming section 9. The paired regist rollers 8*a* and 8*b*, when driven, brings the sheet 4 forward in time registration with the developed image on the photoreceptor 10. The image forming section 9 forms a latent electrostatic image on the photoreceptor 10. The latent image is developed by a developing section 11. The developed image is transferred to the sheet 4 by a transfer section 12. Thereafter, the image is thermally fused to the sheet 4 by means of paired fusing rollers 13*a* and 13*b*. The sheet 4 emanating from the fixing roller pair is transferred by paired transfer rollers 14*a* and 14*b* and paired exit rollers 15*a* and 15*b*, and is discharged to an output tray 16. However, in the laser beam printer, the angles of the sheets from the trays 1 to 3 to the paired regist rollers 8*a* and 8*b* are different from one another. The leading edges of the sheet 4, that are picked up from the trays 1 to 3 and transferred, reach the paired regist rollers 8*a* and 8*b* at different times. That is, the time taken for the sheet 4 to travel from the tray 2 to the regist roller pair is longer than that from the tray 1 to the roller pair; and the time taken for the sheet 4 to travel from the tray 3 to the roller pair is longer than that from the tray 2 to the roller pair. As a result, the through-put of the print processing (the amount of processing per unit time) is different for different trays. To cope with this, a timing chart as shown in FIGS. 11(*a*) through 11(*g*) has been used for the control of the operation from the sheet supply stage to the printing stage in the conventional printing system.

In this printing system, in response to a print command from the host computer, the base machine applies a transfer signal to the pick-up roller 5, which picks up and transfers the sheet 4. When a regist sensor 17 detects the arrival of the sheet 4, the base machine places the paired regist rollers 8*a* and 8*b* in an standby state and sends a vertical sync signal request signal to the host computer. Upon receipt of the request signal, the host computer sends a vertical sync signal and image data signal. In response to those signals, the base machine drives the paired regist rollers 8*a* and 8*b* to set up the time registration of the image on the photoreceptor 10 with the position of the sheet 4.

Thus, at instant that the sheet 4 from any one of the trays 1 to 3 arrives at the paired regist rollers 8*a* and 8*b* and that the base machine is ready for print operation, the base machine sends a vertical sync signal request signal to the host computer. At this time, if the image data to be printed has been prepared in the host computer, that is, the image data processing, such as conversion of the received character codes into image data and conversion of the coordinates of image data into portrait or land scape, has been completed, the host computer sends a vertical sync signal and the image data to the base machine.

In a normal print mode where image data is different for each print, the sheet 4 cannot be moved from the paired regist rollers 8*a* and 8*b* till the host computer produces a vertical sync signal, when the host computer produces a print command to the base machine, the sheet 4 arrives at the paired regist rollers 8*a* and 8*b*, and the base machine sends a vertical sync signal request signal to the host computer, but the image data processing, such as conversion of the received character codes into image data and conversion of the coordinates of image data into portrait and landscape, is not completed in the host computer.

In other words, the base machine can only enter the print operation if the host computer sends a vertical sync signal to the base machine when the host computer completes the above-described data processing. Therefore, in the conventional printing system thus constructed, it is unnecessary for the host computer to determine the timing of the print command depending on the amount of image data and the processing time. Particularly, in the case where the sheet 4 is picked up from the tray 3, transferred, and printed, the task of the host computer for processing the data to control the base machine, which is other than image data, is reduced, leading to improvement of the through-put.

In a copy print mode to print the same image data plural times, the conventional printing system needs, every print, the transfer of the vertical sync signal request signal and the vertical sync signal between the base machine and the host computer. The signal transfer operation is complicated and the processing task of the host computer is large.

SUMMARY OF THE INVENTION

The present invention has been made in view of the above circumstances and has an object to provide an image forming system which can reduce the task of the host computer for processing the base machine control data other than image data, leading to improvement of the through-put.

To achieve the above object, an image forming system according to the present invention is characterized by comprising: a sheet supply section for supplying a sheet of paper; an image forming section for forming an image on the sheet of paper; a transfer path for transferring the sheet of paper from the sheet supply section to the image forming section, the transfer path including a sync transfer section which properly times the transfer of the sheet of paper to the image forming section; detecting means for detecting the arrival of the sheet of paper at the sync transfer section; transfer command check means for checking if a sheet transfer command is present; first print control means for operating such that the sheet of paper is transferred from the sheet supply section to the sheet transfer path when the transfer command check means decides that the sheet transfer command is present, and that the sheet of paper is placed on standby in the sync transfer section when the detecting means detects the arrival of the sheet of paper at the sync transfer section, the first print control means thereafter causing the sheet of paper being on standby to move for transfer, and causing the printing operation of received image data in response to a first print command; and second print control means for operating such that the sheet of paper is transferred from the sheet supply section in response to a second print command when the transfer command check means decides that the sheet transfer command is not present, and that an image data request signal is produced when the sheet paper reaches the sync transfer section, to cause the printing operation of received image data.

BRIEF DESCRIPTION OF THE DRAWINGS

The accompanying drawings, which are incorporated in and constitute a part of this specification illustrate embodiment of the invention and, together with the description, serve to explain the objects, advantages and principles of the invention. In the drawings.

FIG. 8 is a flowchart showing a flow of the image data supply operation by the host computer;

FIG. 9 is a flowchart showing a flow of the print control operation by the base machine;

DETAILED DESCRIPTION OF THE PREFERRED EMBODIMENTS

Figure 1:
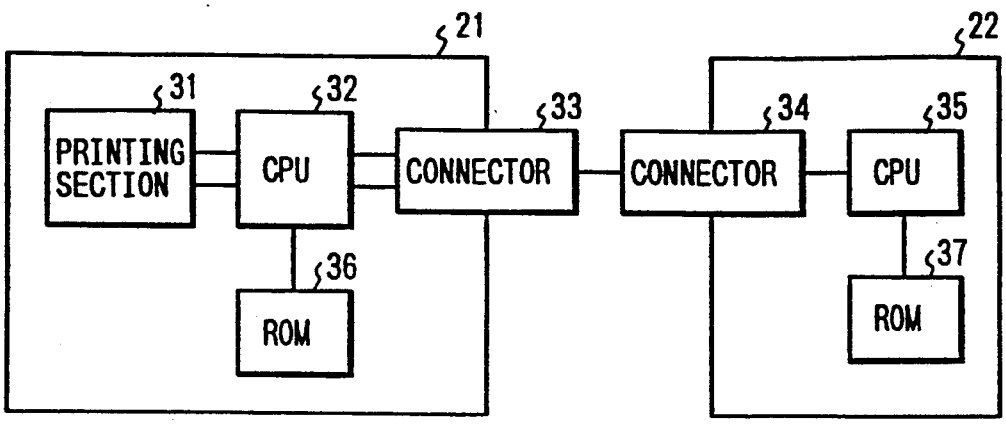
FIG. 1 is a block diagram showing an important part of a laser beam printer according to an embodiment of the present invention.

FIG. 1 is a block diagram showing an important part of a laser beam printer according to an embodiment of the present invention. As shown, the laser beam printer is made up of a base machine 21 as a printing machine and a host computer 22 as an image data supply unit for supplying image data to the base machine 21. The specific structural construction of the base machine 21 is substantially the same as that shown in FIG. 2. Therefore, the detailed description of the construction will be omitted here.

Figure 2:
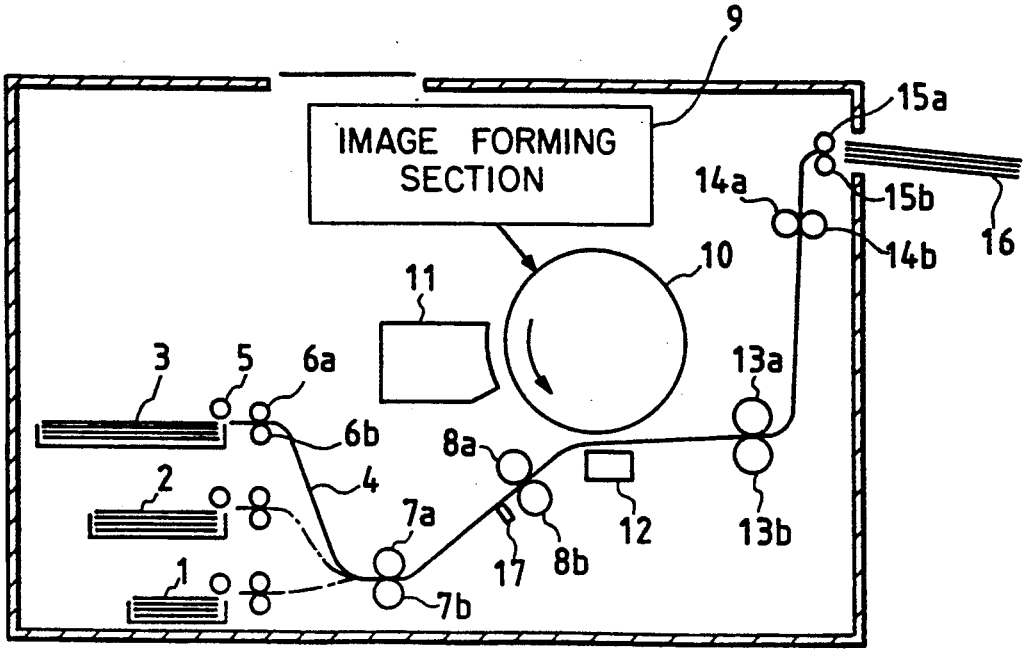
FIG. 2 is a longitudinal sectional view showing an overall construction of the printer shown in FIG. 1.

The base machine 21 is provided with a printing section 31 including the photoreceptor drum 10 shown in FIG. 2 and the like, and a CPU (central processing unit) 32 for controlling the printing section 31. The CPU 32 is coupled with a ROM (read only memory) 36, which stores a program to be described later with reference to FIG. 9. Under control of the program, the CPU 32 controls the printing operation of the printing section 31.

The CPU 32 is coupled with a CPU 35 in the host computer 22, through connectors 33 and 34. The CPU 35 is coupled with a ROM 37, which stores a program to be described later with reference to FIG. 8. Under control of the program, the CPU 35 controls the image data transfer operation.

Interface signals, such as control signals and image signals, are transferred between the CPUs 32 and 35.

Of the control signals, a status signal and the like are used for transferring the status of the base machine 21, such as sheet size and error, to the host computer 22. Further, command signals, such as a transfer command and print commands 1 and 2, which will be described later, are used when the host computer 22 sends instructions for print start, selection of one of the trays 1 to 3, and the like, to the base machine 21.

Of the image signals, sync signals corresponding to page, line and dot are transferred between the base machine 21 and the host computer 22 for the printing operation.

Figure 3:
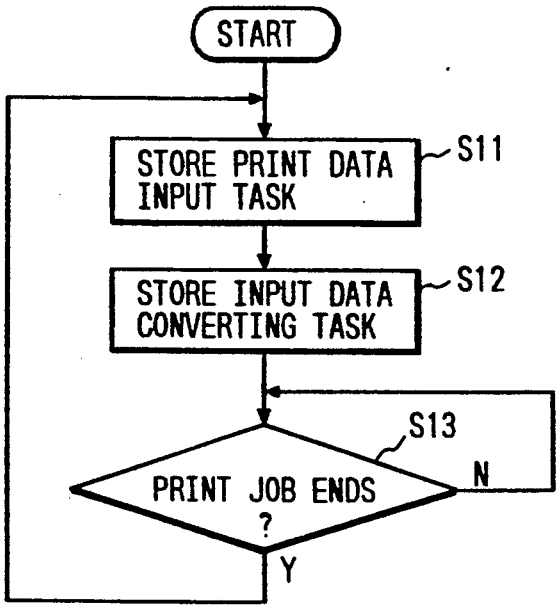
FIG. 3 is a flowchart showing an example of a flow of task of the host computer when the control mode of the base machine is switched between a copy print mode and a normal print mode.

FIG. 3 is a flowchart showing an example of a flow of task of the host computer 22 when the control mode of the base machine 21 is switched between a copy print mode and a normal print mode. In the host computer 22, input task of print data is stored (step S11), and then input data converting task is stored (step S12). When a print job ends (step S13, Y), control returns to step S11.

Figure 4:
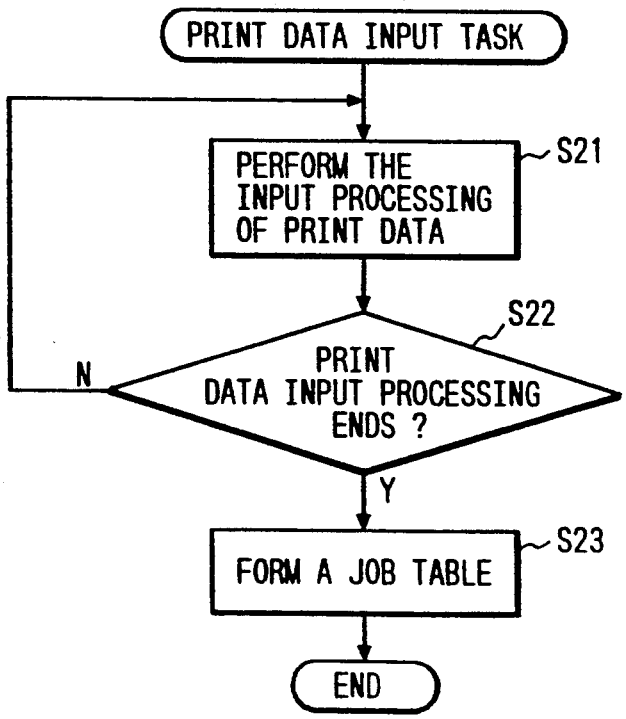
FIG. 4 is a flowchart showing a flow of the print data input task.
Figure 5:
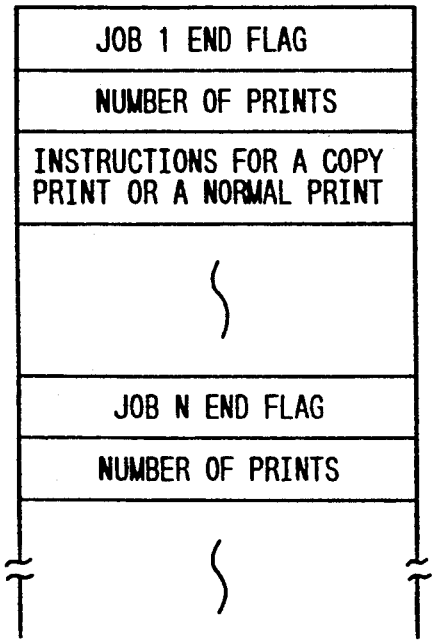
FIG. 5 is a diagram showing an example of a job table.

FIG. 4 is a flowchart showing a flow of the print data input task. As shown, the input processing of print data is performed (step S21). When the input processing of print data ends (step S22, Y), a job table as shown in FIG. 5 is prepared (step S23).

Figure 6:
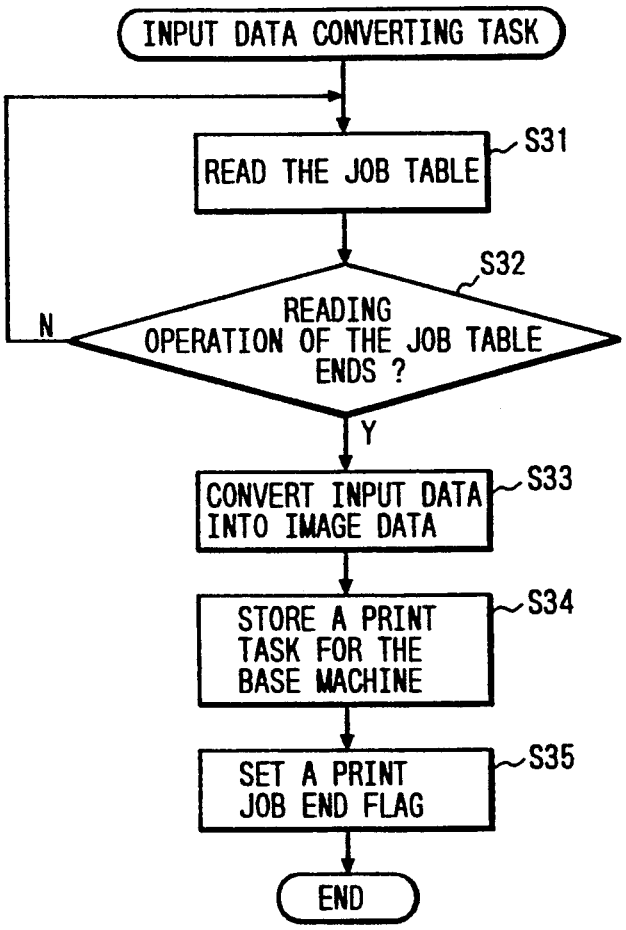
FIG. 6 is a flowchart showing a flow of the input data converting task.

FIG. 6 is a flowchart showing a flow of the input data converting task. Control reads the job table (step S31). When the reading operation of the job table ends (step S32, Y), control converts input data into image data (step S33). Thereafter, control stores a print task for the base machine 21 (step S34), and sets a print job end flag (step S35).

Figure 7:
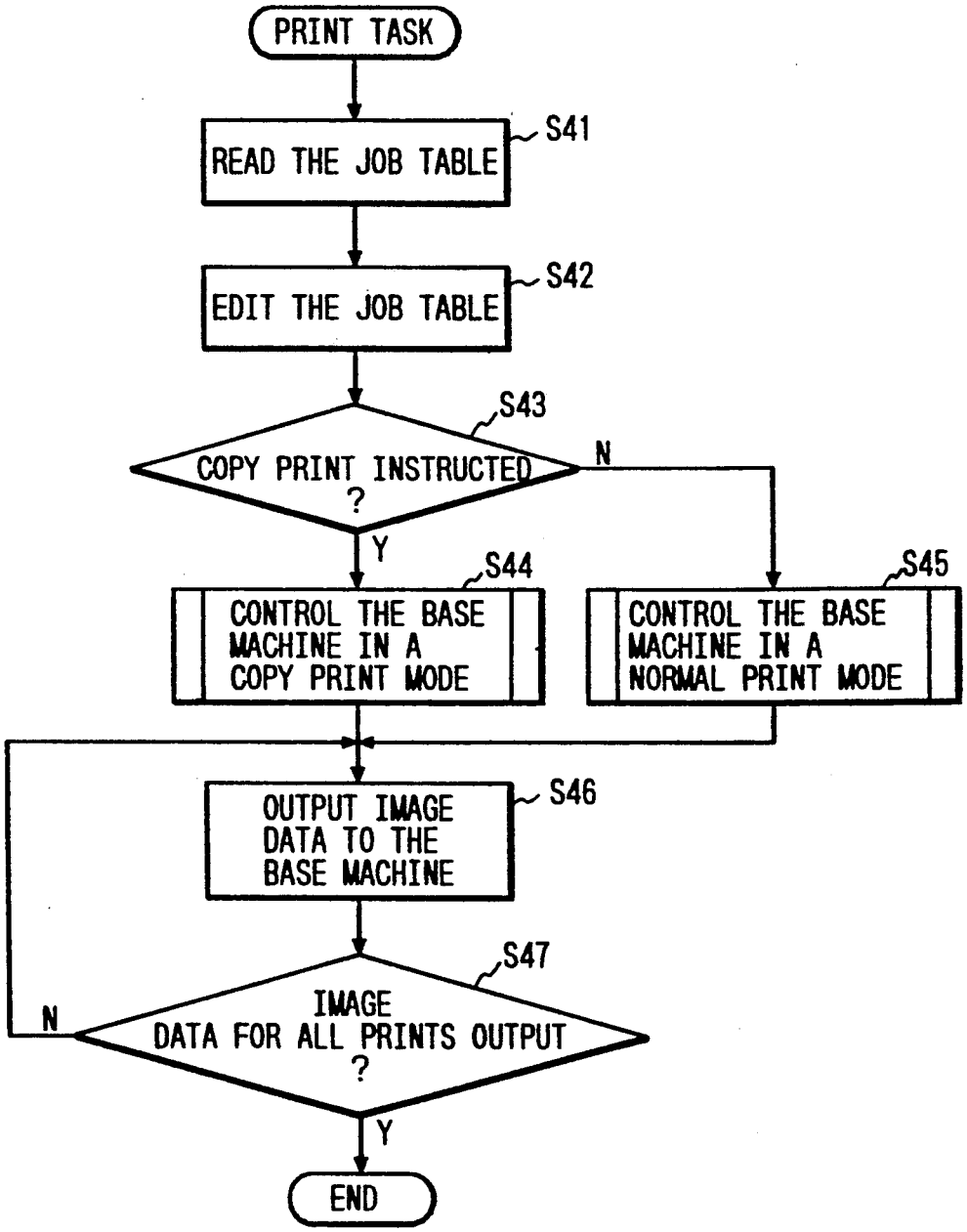
FIG. 7 is a flowchart showing a flow of the print task.

FIG. 7 is a flowchart showing a flow of the print task. Control reads the job table (step S41), edits the job table (step S42), and checks if a copy print is instructed (step S43). If the copy print is instructed (step S43, Y), control operates the base machine 21 in a copy print mode (step S44). Then, control sends image data to the base machine 21 (step S46), and outputs the image data for all prints (step S47). Then, control ends the processing of the print task. If no instruction of a copy print is given (step S43, N), control operates the base machine 21 in a normal print mode (step S45), and executes step S46 and the subsequent steps.

Figure 10:
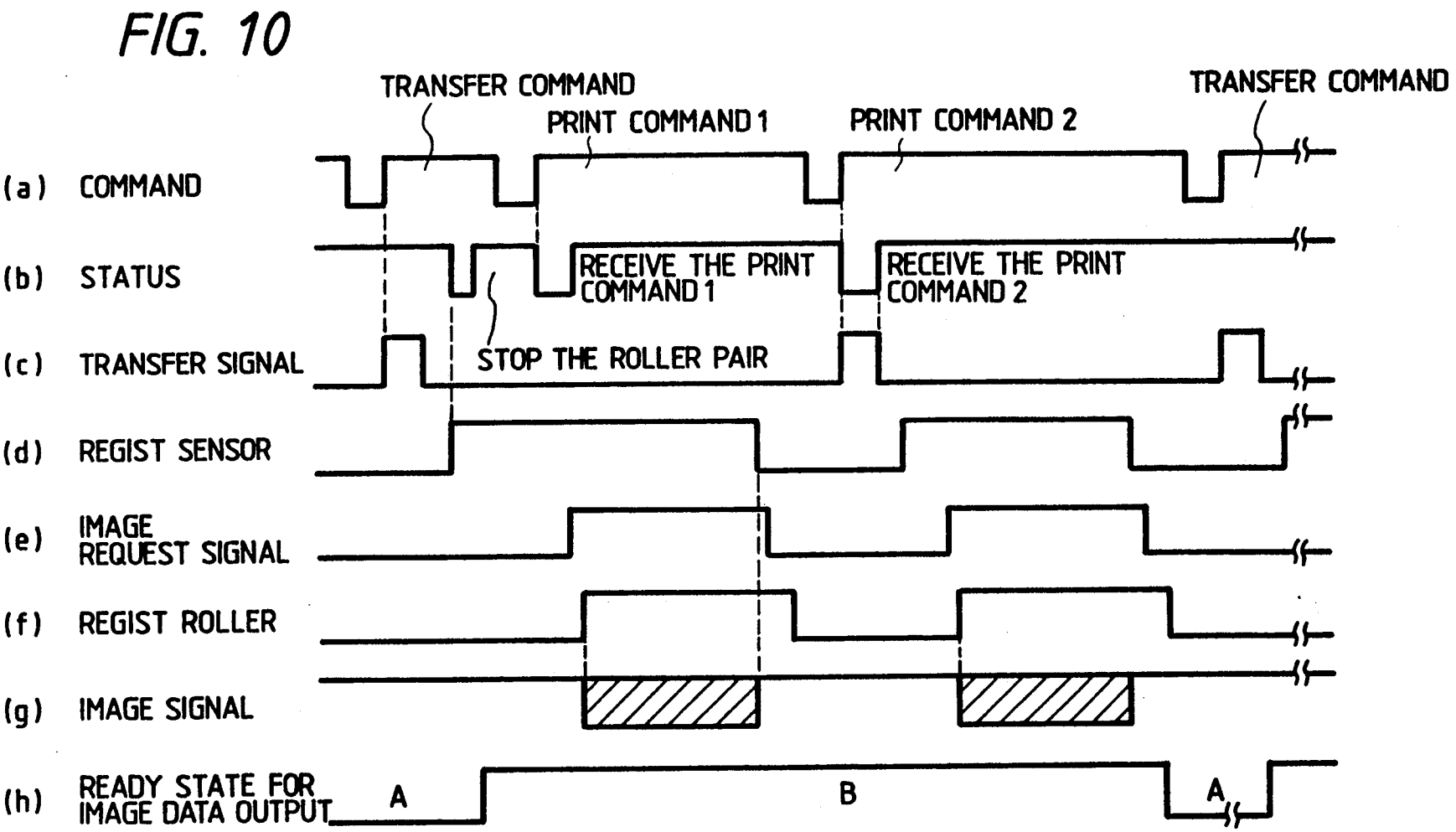
FIG. 10 is a timing chart useful in explaining the operation of the printer shown in FIG. 1.
Figure 11:
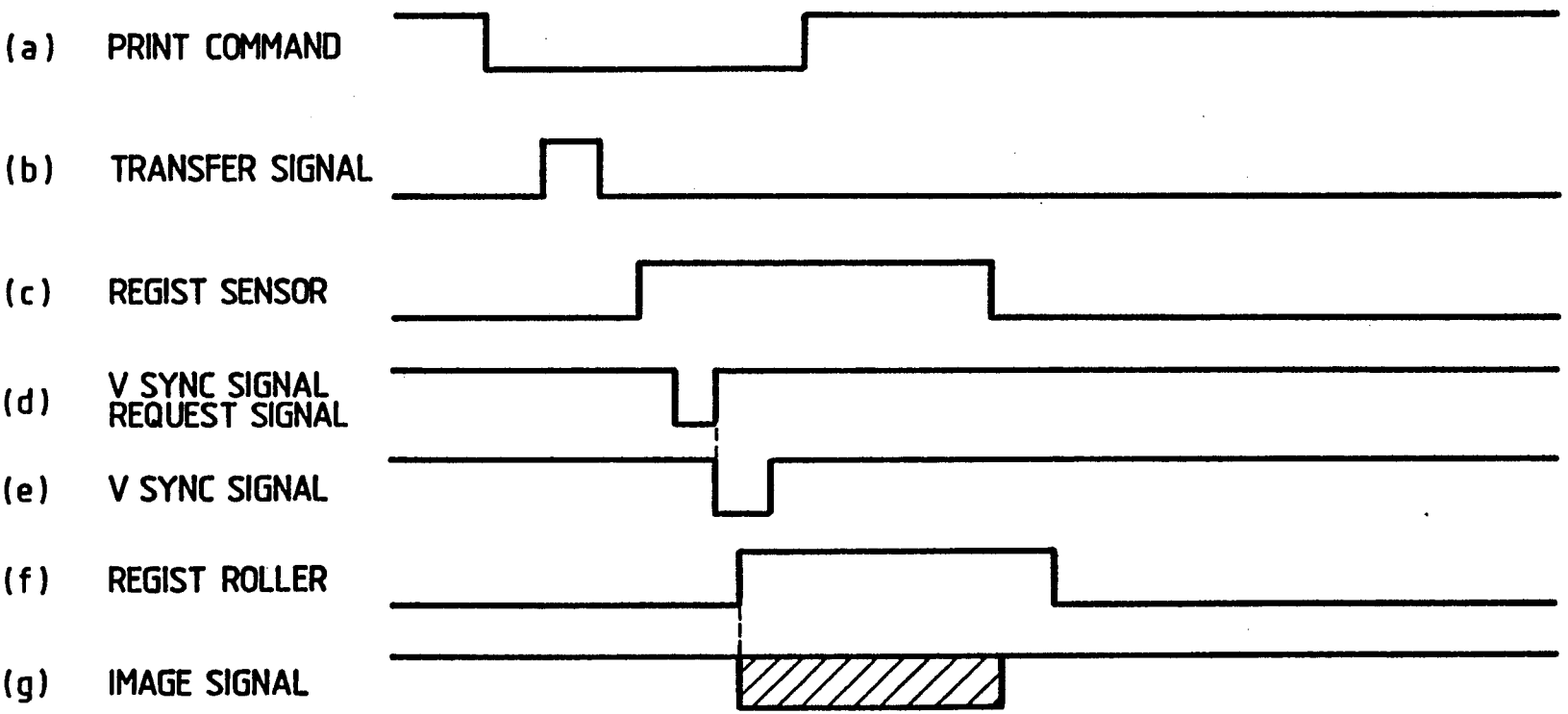
FIG. 11 PRIOR ART
FIG. 11 is a timing chart useful in explaining the operation of a conventional printing system.

The control operation of the laser beam printer, which ranges from transfer of the sheet 4 to print processing, will be described with reference to FIGS. 8, 9 and 10. FIG. 8 is a flow chart showing a flow of the image data supply operation by the host computer 22. FIG. 9 is a flow chart showing a flow of the print control operation by the base machine 21. FIG. 10 is a timing chart useful in explaining the operation of the printer shown in FIG. 1. In the instant embodiment, a first print mode is a normal print mode, and a second print mode is a copy print mode.

On the side of the host computer 22, an operator sets up a print mode (step S51). If the print mode set up is a normal print mode (step S52, N), the CPU 35 of the host computer sends a transfer command before print to the base machine 21 (step S61), to instruct the base machine to pick up the sheet 4 from a selected tray, for example, the tray 3, and transfer the sheet. This is performed in a state A (FIG. 10(*h*)) where the host computer 22 has not yet completed the processing of image data to be printed, such as the processing to convert the received character code groups into image data, and the processing to convert the coordinates of image data into portrait or landscape. Subsequently, the CPU 35 performs the image processing not yet completed (step S62). That is, the CPU 35 converts the received character code groups into image data and converts the coordinates of image data into portrait or landscape. The CPU 35 outputs a print command 1 (step S63), and outputs image data (step S64).

If the print mode set up is a copy print mode (step S52, Y), the CPU 35 sets the number of prints (M) in a number-of-prints memory, not shown (step S53), and checks whether or not the present print processing is applied to the first sheet (step S54). If it is applied to the first sheet (step S54, Y), the CPU sends a transfer command as in the normal copy mode (step S61), and performs the image processing (step S62). Afterwards, the CPU 35 outputs a print command 1 (step S63), and outputs image data (step S64).

After outputting the image data, the CPU 35 checks whether or not the present print mode is the copy print mode (step S65). If it is the normal print mode (step S65, N), the CPU 35 ends the processing of image data supply. If it is the copy print mode (step S65, Y), the CPU 35 advances to step S58 to be described later.

In step S54, if the CPU 35 of the host computer 22 decides that the sheet is any one of the second sheet and the subsequent ones (step S54, N), the CPU outputs or sets a print command 2 (step S55). In response to the command, the CPU 32 of the base machine 21 outputs an image data request signal toward the host computer. The CPU 35 receives the image data request signal (step S56, Y), and outputs image data (step S57). The CPU 35 checks whether or not the number of prints stored in the number-of-prints memory have been printed (steps S58 and step S59). If all the number of prints have been printed (step S59, Y), the CPU 35 resets the output of the print command 2 (step S60). If not yet printed (step S59, N), the CPU returns to step S55.

Responsive to the image data supply operation by the host computer 22, the base machine 21 performs a print control operation as shown in FIG. 9. First of all, an operator turns on a power switch (step S71). In turn, the CPU 32 initializes the printer (step S72), and checks if the warm-up processing is completed (step S73). If the warm-up processing is completed (step S73, Y), the CPU 32 checks whether or not an error is occurred, such as improper fusing and jamming of sheet (step S74). If an error is occurred (step S74, Y), the CPU 32 places the machine per se in an error processing state (step S83), and requests the operator to remove the error.

When no error takes place (step 74, N), the CPU 32 checks whether or not a transfer command is issued from the CPU 35 of the host computer 22 (step S75). When receiving the transfer command (step S75, Y), the CPU 32 outputs a transfer signal, and drives the pick-up roller 5 and paired transfer rollers 6*a* and 6*b*, to transfer the sheet 4 from the tray 3 to the paired regist rollers 8*a* and 8*b* (step S84). The regist sensor 17 detects the arrival of the sheet 4, and the CPU 32 receives a detect signal from the regist sensor 17 (step S85, Y). Then, the CPU 32 produces a regist roller stop signal to stop the drive of the paired regist rollers 8*a* and 8*b*, and places the sheet 4 in a ready state (step S86).

Thereafter, on the side of the host computer 22, the processing of image data is completed and a state B where the computer is ready for the output of image data is reached (FIG. 10(*h*)). At this time, the CPU 35 of the host computer 22 transfers a print command 1 and image data to the CPU 32 of the base machine 21, as described above. When the CPU 32 receives the print command 1 (step S87, Y), the CPU drives the paired regist rollers 8*a* and 8*b*, receives the image data from the host computer 22 (step S88), and drives the printing section 31 for printing operation (step S82).

On the other hand, when no transfer command is issued (step S75, N), the CPU 32 decides that the print mode is the copy print mode and waits for a print command 2 from the host computer 22. When receiving this print command 2 (step S76, Y), the CPU 32 produces a transfer signal to drive the pick-up roller 5 and the paired transfer rollers 6*a* and 6*b*, to transfer the sheet 4 from the tray 3 to the paired regist rollers 8*a* and 8*b* (step S77). Then, the regist sensor 17 detects the arrival of the sheet 4 to produce a detect signal. When receiving the detect signal (step S78, Y), the CPU 32 sends an image data request signal to the CPU 35 in the host computer 22 (step S79), and drives the paired regist rollers 8*a* and 8*b*. Then, the CPU 32 receives image data from the host computer 22 (step S81), and drives the printing section 31 to print (step S82). After the print operation is completed, the CPU returns to step S75. In the step, the CPU checks if the print mode is the normal print mode or the copy print mode, depending on presence or absence of the transfer command, and traces the subsequent procedural steps.

As described above, in the laser beam printer of the present embodiment, the host computer 22 produces a transfer command in the normal print mode, and transfers the sheet 4 to the paired regist rollers 8*a* and 8*b*. Under this condition, if an image request signal from the base machine 21 is present, the sheet 4 does not move from the position of the paired regist rollers 8*a* and 8*b* until the host computer 22 has prepared image data and issues a print command 1. At instant that the host computer 22 has prepared image data and issued a print command 1, the paired regist rollers 8*a* and 8*b* are driven to set the printer ready for print. With such an operation, it is unnecessary for the host computer 22 to determine the timing of the print command depending on the amount of image data and the processing time. Particularly, in the case where the sheet 4 is picked up from the tray 3, transferred, and printed, the task of the host computer 22 for processing the data to control the base machine 21, which is other than image data, is reduced, leading to improvement of the through-put.

On the other hand, in the copy print mode, when receiving a print command 2, the base machine 21 drives the paired regist rollers 8*a* and 8*b* when it sends an image data request signal to the host computer 22, without a drive instruction from the host computer 22. Therefore, after completing the image data preparation, the host computer 22 produces a print command 2 every sheet. Subsequently, it is only needed that the host computer 22 outputs image data in response to an image data request signal from the base machine 21. Therefore, the operation is very simple, and the processing task to be done by the host computer is also reduced, improving the through-put.

Thus, when using the laser beam printer of the present embodiment, the printing operation can be effectively timed without any interruption of the operation of the base machine 21 by appropriately using a transfer command and a print command 1 or a print command 2 in accordance with the processing state of image data in the host computer 22 per se. Therefore, the through-put may be improved in either the normal print mode or the copy print mode.

Also in the laser beam printer, even in the copy print mode, the first sheet 4 is previously positioned at the paired register rollers 8*a* and 8*b* by a transfer command issued from the CPU 35, as in the normal print mode (steps S54, and S61 to S64 in FIG. 8). Therefore, the base machine can start the print operation immediately after the preparation of image data is completed in the host computer 22. This quickens the processing of the first sheet 4.

While there has been described what is at present considered to be the preferred embodiment of the invention, it will be understood that various modifications may be made therein, it is intended to cover in the appended claims all such modifications as fall within the true spirit and scope of the invention. In the embodiment as mentioned above, the sheet 4 is transferred from one of the three trays 1 to 3, which have different distances to the regist rollers 8*a* and 8*b*. If required, the distances of the trays to the regist rollers 8*a* and 8*b* may be equal to one another.

Also in the above-mentioned embodiment, the processing of the first sheet 4 in the copy print mode is set to be the same as in the normal print mode; that is, both modes are operated in a composite manner. However, both modes may be separately operated.

The embodiment is constructed such that various instructions are directly transferred from the host computer 22 to the base machine 21. If required, any other proper data processor, such as a personal computer and a word processor, may be used for the host computer. In this case, a controller may be provided between the personal computer, for example, and the base machine 21. The instructions from the personal computer are temporarily stored in the CPU of the controller. Then, the controller transfers the instructions to the base machine 21.

It is evident that the present invention may be applied not only to the laser beam printer, but also to another printer system.

As seen from the foregoing description, the image forming system of the invention is operated as follows. In a first print mode, in the sync transfer section the sheet is placed on standby every print, in response to a transfer command from an image data supply section. In a second print mode, the sheet is immediately printed in response to a second print command without being on standby in the sync transfer section. Therefore, the print operation can be effectively timed without interrupting the operation of a print control section. The task of the image data supply section for processing the data to control the print control section, which is other than image data, is reduced, leading to improvement of the through-put.

The foregoing description of preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image forming system, comprising:

a sheet supply section for supplying a sheet of paper;

an image forming section for forming an image on the sheet of paper;

a transfer path for transferring the sheet of paper from said sheet supply section to said image forming section, said transfer path including a sync transfer section which properly times the transfer of the sheet of paper to said image forming section;

detecting means for detecting the arrival of the sheet of paper at said sync transfer section;

transfer command check means for checking if a sheet transfer command is present;

first print control means for transferring the sheet of paper from said sheet supply section to said sheet transfer path and, when said detecting means detects arrival of the sheet of paper at said sync transfer section, for placing the sheet of paper on standby in said sync transfer section, said first print control means thereafter causing the sheet of paper being on standby to move to said image forming section and causing the printing operation of received image data in response to a first print command, said first print control means being operated when said transfer command check means determines that the sheet transfer command is present; and second print control means for transferring the sheet of paper from said sheet supply section to said sheet transfer path and for producing an image data request signal when the sheet of paper reaches said sync transfer section without stopping the sheet of paper at said sync transfer section, in order to cause the printing operation of the received image data in response to a second print command, said second print control means being operated when said transfer command check means determines that the sheet transfer command is not present, wherein when said image is to be printed on a predetermined number of sheets, said first control means operates on a first sheet and said second control means operates on the remaining sheets of said predetermined number of sheets.

2. An image forming system, comprising:

a sheet supply section for supplying a sheet of paper;

an image forming section for forming an image on the sheet of paper;

a transfer path for transferring the sheet of paper from said sheet supply section to said image forming section, said transfer path including a sync transfer section which properly times the transfer of the sheet of paper to said image forming section;

detecting means for detecting the arrival of the sheet of paper at said sync transfer section;

print mode select means for selecting a first print mode or a second print mode;

first output control means, operative when the first print mode is selected by said print mode select means, for outputting a sheet transfer command, processed image data, and a first print command;

second output control means, operative when the second print mode is selected by said print mode select means, for outputting a second print command, and for outputting image data in response to an image data request signal;

transfer command check means for checking if a sheet transfer command issued from said first output control means if present;

first print control means for transferring the sheet of paper from said sheet supply section to said sheet transfer path and, when said detecting means detects arrival of the sheet of paper at said sync transfer section, for placing the sheet of paper on standby in said sync transfer section, said first print control means thereafter causing the sheet of paper being on standby to move to said image forming section and causing the printing operation of received image data in response to a first print command, said first print control means being operated when said transfer command check means determines that the sheet transfer command is present; and second print control means for transferring the sheet of paper from said sheet supply section to said sheet transfer path and for producing an image data request signal when the sheet of paper reaches said sync transfer section without stopping the sheet of paper at said sync transfer section, in order to cause the printing operation of the received image data in response to a second print command, said second print control means being operated when said transfer command check means determines that the sheet transfer command is not present, wherein when said image is to be printed on a predetermined number of sheets, said first control means operates on a first sheet and said second control means operates on the remaining sheets of said predetermined number of sheets.

3. The image forming system according to claim 2, further comprising means for judging the number of sheets upon which a particular image is to be printed, said judging means selecting said first output control means when said judging means judges that the number of sheets is less than or equal to a predetermined number, or when a current sheet being printed is the first sheet upon which said particular image is to be printed, and said judging means selecting said second output control means when said judging means judges that the number of sheets if larger than said predetermined number, or when the current sheet being printed is not the first sheet upon which said particular image is to be printed.

4. The image forming system according to claim 3, wherein said predetermined number is one.

5. The image forming system according to claim 2, wherein said print mode select means and said first and second output control means make up an image data supply section, and said transfer command check means and said first and second print control means make up a print control section.

6. The image forming system according to claim 2, wherein said sheet supply section includes a plurality of sheet trays.

* * * * *

UNITED STATES PATENT AND TRADEMARK OFFICE

CERTIFICATE OF CORRECTION

PATENT NO. : 5,294,966

DATED : March 15, 1994

INVENTOR(S) : Masami Shiokawa

It is certified that error appears in the above-indentified patent and that said Letters Patent is hereby corrected as shown below:

Claim 2, column 9, line 10, change "if" to --is--.

Claim 3, column 10, line 18, change "if" to --is--.

Signed and Sealed this

First Day of November, 1994

*Attest:*

*Attesting Officer*

BRUCE LEHMAN

*Commissioner of Patents and Trademarks*